US011692391B2

(12) United States Patent
Morgan, III et al.

(10) Patent No.: US 11,692,391 B2
(45) Date of Patent: Jul. 4, 2023

(54) IDLE END ASSEMBY

(71) Applicant: Lafayette Venetian Blind, Inc., West Lafayette, IN (US)

(72) Inventors: Joe Nash Morgan, III, West Lafayette, IN (US); Kia Kheng Kho, West Lafayette, IN (US); Derek Bollhoefer, West Lafayette, IN (US); Adam Vandewalle, Lafayette, IN (US)

( * ) Notice: Subject to any disclaimer, the term of this patent is extended or adjusted under 35 U.S.C. 154(b) by 183 days.

(21) Appl. No.: 16/405,978

(22) Filed: May 7, 2019

(65) Prior Publication Data

US 2020/0355027 A1 Nov. 12, 2020

(51) Int. Cl.
*E06B 9/50* (2006.01)

(52) U.S. Cl.
CPC ..... *E06B 9/50* (2013.01)

(58) Field of Classification Search
CPC ..... E06B 9/50; E06B 9/42; E06B 9/68; E06B 2009/6881
See application file for complete search history.

(56) References Cited

U.S. PATENT DOCUMENTS

| | | | | |
|---|---|---|---|---|
| 4,487,245 | A | 12/1984 | Shinohara et al. | |
| 5,975,186 | A | 11/1999 | Day | |
| 6,497,267 | B1 * | 12/2002 | Azar | E06B 9/42 160/188 |
| 6,710,606 | B2 | 3/2004 | Morris | |
| 6,817,402 | B1 | 11/2004 | Fraczek et al. | |
| 8,763,676 | B2 | 7/2014 | Barnes et al. | |
| 2002/0109034 | A1 * | 8/2002 | Moody | A47K 10/38 242/559.1 |
| 2005/0077017 | A1 * | 4/2005 | Ramsey | E06B 9/42 160/238 |
| 2009/0090805 | A1 | 4/2009 | Hwaung | |
| 2013/0327670 | A1 | 12/2013 | Frederiksen | |
| 2014/0014280 | A1 | 1/2014 | Bohlen | |
| 2014/0262081 | A1 * | 9/2014 | Seib | E06B 9/50 160/325 |
| 2015/0041077 | A1 * | 2/2015 | Campagna | E06B 9/44 160/326 |
| 2015/0047795 | A1 | 2/2015 | Bohlen et al. | |
| 2015/0107788 | A1 | 4/2015 | Mullet et al. | |

(Continued)

FOREIGN PATENT DOCUMENTS

| | | |
|---|---|---|
| AU | 2007231870 A1 | 6/2008 |
| GB | 1451225 | 9/1976 |

OTHER PUBLICATIONS

Timken, Timken Ball Bearings Catalog, retrieved from https://www.timken.com/resources/timken-ball-bearings-catalog/ (Year: 2014).*

(Continued)

*Primary Examiner* — Daniel P Cahn
*Assistant Examiner* — Abe Massad
(74) *Attorney, Agent, or Firm* — Gutwein Law; Greg Geiser

(57) ABSTRACT

The present disclosure relates to a roller blind idle end assembly for roller blinds comprising a splined bush, a support, a spring, two sealed ball bearings, rotor, metal strap, and an end pin. This assembly reduces friction, wear and the likelihood of failure of the idle end assembly, creating a quiet design and dissipating static electricity.

9 Claims, 2 Drawing Sheets

(56) References Cited

U.S. PATENT DOCUMENTS

| | | | | |
|---|---|---|---|---|
| 2015/0280363 | A1* | 10/2015 | Rynaski | B65H 75/4402 439/371 |
| 2016/0340977 | A1* | 11/2016 | Faller | E06B 9/322 |
| 2017/0067289 | A1* | 3/2017 | Campagna | E06B 9/72 |
| 2018/0106102 | A1* | 4/2018 | Holt | E06B 9/42 |
| 2020/0165865 | A1* | 5/2020 | Buccola | E06B 9/44 |
| 2020/0303988 | A1* | 9/2020 | Meynet | E06B 9/68 |
| 2020/0386046 | A1* | 12/2020 | Tan | E06B 9/50 |

OTHER PUBLICATIONS

Blaine Copenheaver, International Search Report for PCT/US20/21784, dated May 15, 2020, 2 pages, USPTO as ISA/US.

Blaine Copenheaver, Written Opinion of the International Searching Authority for PCT/US20/21784, dated May 15, 2020, 6 pages, USPTO as ISA/US.

* cited by examiner

IDLE END ASSEMBY

FIELD

The field of the present disclosure relates to a roller blind idle end assembly for reducing friction, wear and the likelihood of failure of the blind, creating a quiet design and to dissipate static electricity.

BACKGROUND

In conventional roller blinds, a roller tube is mounted between a pair of roller blind end plugs. This is typically achieved by providing the end plugs with a number of splines or fins which in use are located within the roller blind tube. At one end of the roller blind, the roller blind end plug is part of the control end assembly which operates the blind; at the other end, the other roller blind end plug is part of the idle end assembly. Typically, the roller blind idle end assembly is mounted upon a sprung loaded idle end pin, which is located within an idle end bracket when the blind is fitted. Typically the idle end pin is fabricated in a plastic material, while the bracket is metal.

U.S. Pat. No. 5,975,186 provides a general description on all aspects of a basic roller shade including using a spring 212 to spring load the idle end mounting 5. This structure of an idle end mounting is generally referred to as S series by one having ordinary skill in the art. These springs are designed for mounting and are not used to dissipate static electricity.

U.S. Pat. No. 8,763,676 describes a splined bushing 2 and open support bearing system 3 comprised of plastic and its compression spring 16 designed for mechanical function to hold the idle end in place. Spring 16 is not used to dissipate static electricity.

U.S. Pat. No. 6,817,402 (assignee: Rollease) describes an Idle end assembly 10 consisting of a drum 34 and a bushing 36 rotatably inserted into the drum 36. End plug 14B is formed with a drum 38 and a capstan 40. See FIG. 1. Idle end assembly 10 and 14B are generally referred to as R series by one having ordinary skill in the art.

SUMMARY

In one aspect of the disclosure, an idle end assembly for a roller blind, comprising a splined bush, a support, a spring, two sealed ball bearings, rotor, metal strap, and an end pin.

In a further aspect of the disclosure, a method of making an idle end assembly, comprising the steps of inserting a support having threads engaging one of two sealed ball bearings into a void defined by a splined bush, inserting a spring into a void defined by the support, two sealed ball bearings, inserting a rotor having threads engaging a second of two sealed ball bearings into the void defined by the splined bush, engaging an insert of the support with a void defined by the rotor, threading an end pin through a metal strap and through an aperture defined by the rotor and the insert of the support, the end pin engaging the spring.

BRIEF DESCRIPTION OF THE DRAWINGS

The above-mentioned and other features of this disclosure, and the manner of attaining them, will become more apparent and the disclosure itself will be better understood by reference to the following description of embodiments of the disclosure taken in conjunction with the accompanying drawings, wherein:

Unless otherwise stated, a reference to a compound or component includes the compound or component by itself, as well as in combination with other compounds or components, such as mixtures of compounds.

As used herein, the singular forms "a", "an" and "the" include the plural reference unless the context clearly dictates otherwise.

All publications, patents and patent applications cited herein, whether supra or infra, are hereby incorporated by reference in their entirety to the same extent as if each individual publication, patent or patent application was specifically and individually indicated to be incorporated by reference.

Figures 1, 2:
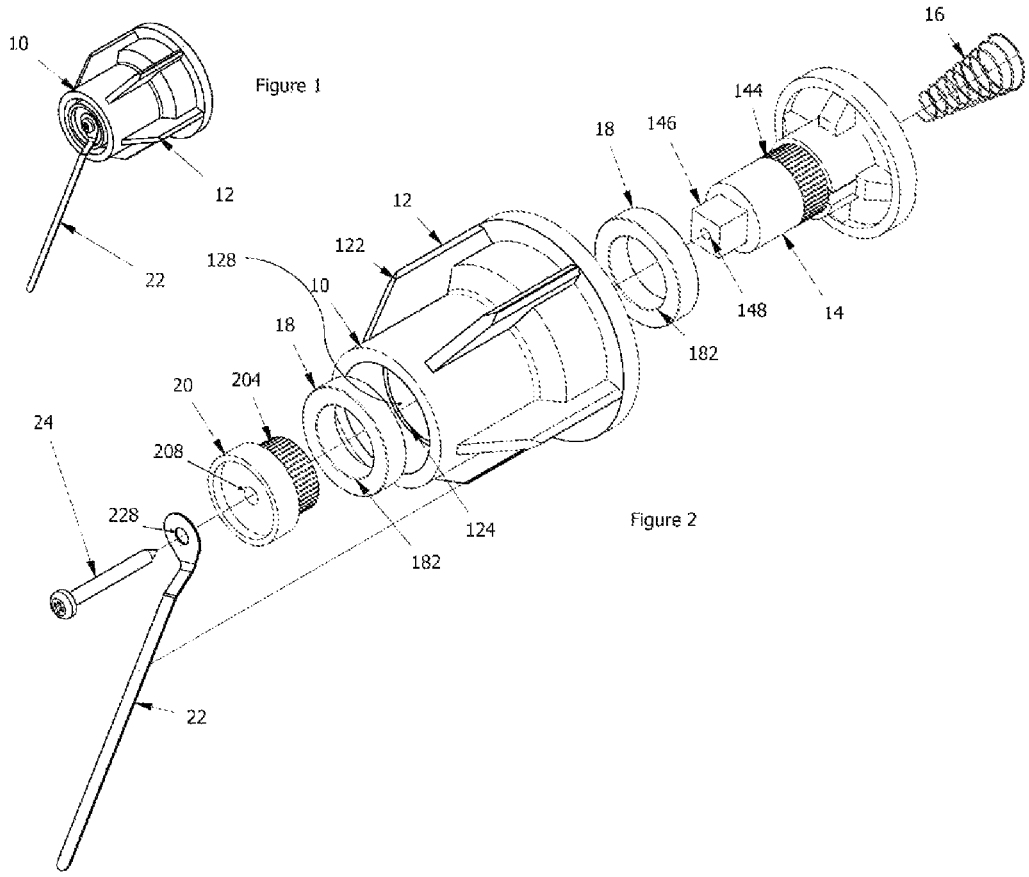

FIG. 1 shows an orthogonal view of an idle end assembly of the present disclosure.

FIG. 2 shows an exploded view of an idle end assembly of FIG. 1.

Figure 3:
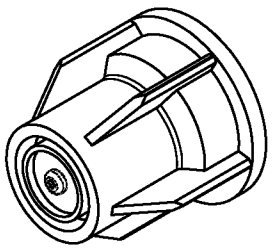

FIG. 3 shows an orthogonal view of another idle end assembly of the present disclosure.

Figure 4:
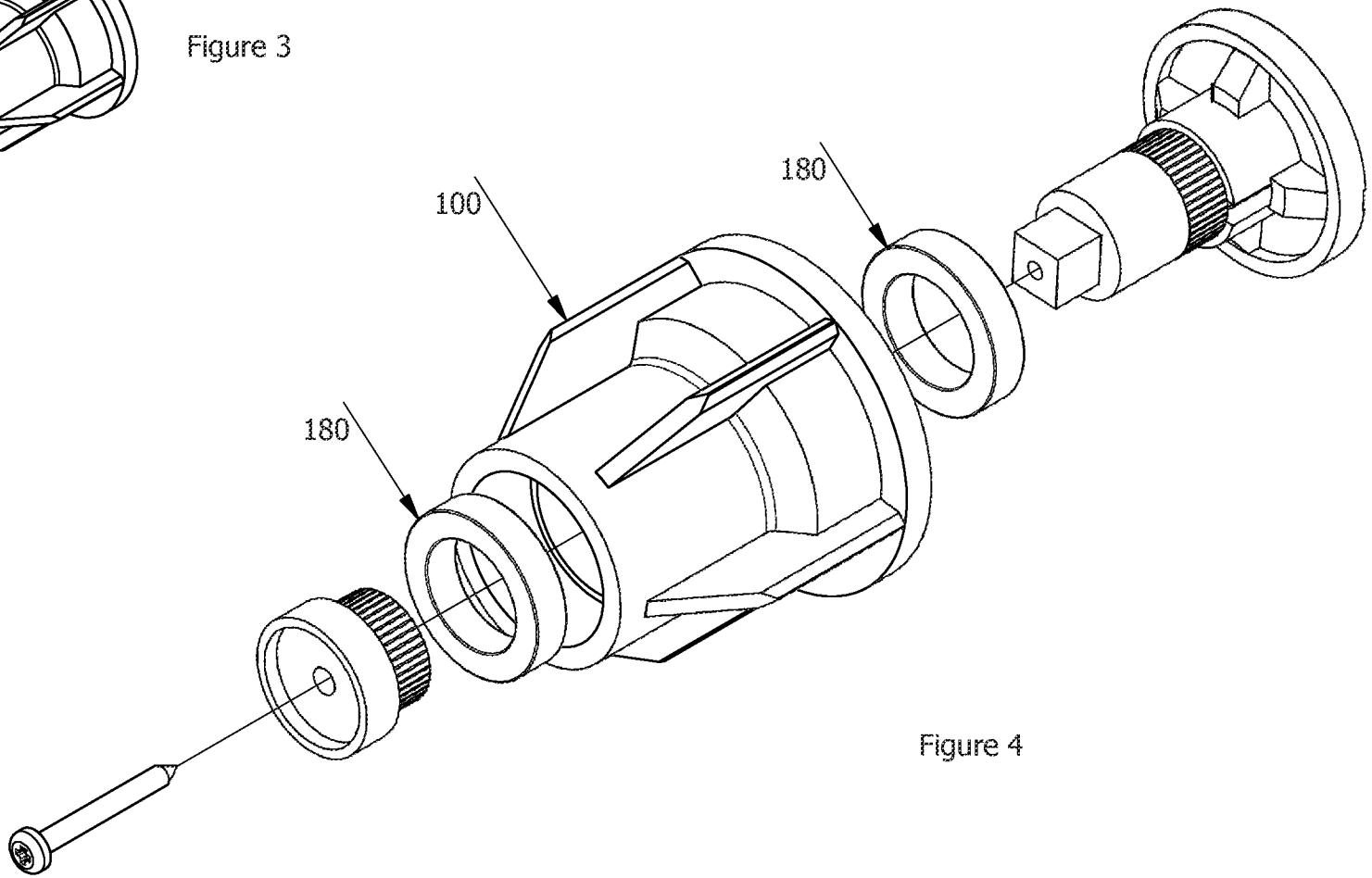

FIG. 4 shows an exploded view of an idle end assembly of FIG. 3.

Corresponding reference characters indicate corresponding parts throughout the several views. Although the drawings represent embodiments of the present disclosure, the drawings are not necessarily to scale and certain features may be exaggerated in order to better illustrate and explain the present disclosure.

DETAILED DESCRIPTION OF THE EXEMPLARY EMBODIMENTS

The embodiments disclosed below are not intended to be exhaustive or limit the disclosure to the precise forms disclosed in the following detailed description. Rather, the embodiments are chosen and described so that others skilled in the art may utilize their teachings.

Referring first to FIGS. 1 and 2, a roller blind system (not shown) may be constructed in accordance with this disclosure including among other things, an idle end assembly 10. Idle end assembly 10 is configured to be inserted telescopically into a roller blind (not shown) and are supported by the end brackets. The roller blind can be secured to the frame of a window or other similar fixture (not shown).

The roller blind includes a roller tube (not shown) with a control end assembly engaged with the roller tube. Rotating the roller tube in one direction causes a panel (not shown) to wind up onto the roller tube while rotating the roller tube in the opposite direction causes the panel (not shown) to wind down. The ends of the roller tube are hollow to receive end assemblies (idle end assembly 10 and control end assembly not shown). In fact, the whole roller tube is typically hollow.

Idle end assembly 10 comprises a splined bush 12, a support 14, a spring 16, two sealed ball bearings 18, rotor 20 and, metal strap 22, and an end pin 24. Idle end assembly 10 is optionally packaged in a sealed plastic container with a rubber band (not shown) biasing metal strap 22 adjacent to splined bush 12.

Splined bush 12 includes a number of splines or fins 122 which in use are located within the roller blind tube. Splined bush 12 includes a plurality of inner diameter cylindrical surfaces 124 and 126. Surfaces 124 and 126 having different internal diameters and may comprise a plurality of different internal diameters. Surfaces 124 and 126 also define void 128.

Splined bush 12 includes a number of splines or fins 122 which in use are located within the roller blind tube. Splined bush 12 includes inner cylindrical surface 124. Surface 124 may comprise a plurality of different diameters. Surface 124 also defines void 128.

Spring 16 is configured to reside within support 14. Support 14 also includes threads 144 which are configured to engage the inner surface of one of the two sealed ball bearings 18. Support 14 also includes a polygon cross sectional insert 146 configured to engage the rotor 20. Rotor 20 defines aperture 208 through which end pin 24 is configured to pass. Metal strap 22 defines aperture 228 through which end pin 24 is configured to pass. Insert 146 also defines aperture 148 through which end pin 24 is configured to pass and engage with spring 16. Spring 16 is connected to metal strap 22, via end pin 24, which is configured to be connected to earth via roller tube and roller blind. Idle end assembly 10, via spring 16, end pin 24, metal strap 22, dissipates static electricity.

Rotor 20 includes threads 204 which are configured to engage the inner surface 182 of second of the two sealed ball bearings 18. As best illustrated in FIG. 1, idle end assembly 10 utilizes two sealed ball bearings 18 for reducing friction and wear between support 14 and splined bush 12 as well as between rotor 20 and splined bush 12. Two sealed ball bearings 18 reduces the likelihood of failure of the blind and creates a quiet design.

Support 40 defines a slot (not shown). Slot could be shaped to define two or more different slots disposed, for example, orthogonal to each other. As is well known in the art, bushing (not shown) or other parts of roller blind may define parts to engage with slot. Idle end assembly is configured to be installed and oriented with parts and be positioned coaxially with the axis of the roller tube.

The structure and description of idle end assembly can be utilized for any number of roller blinds including motorized systems, such as electric motor systems.

As illustrated in FIGS. 3 and 4, idle end assembly 100 comprises a splined bush 12, a support 14, two greased bushings 180, rotor 20 and an end pin 24. Idle end assembly 100 is the same as idle end assembly 10 except as described below. Instead of two sealed ball bearings 18, idle end assembly 100 includes two greased bushings 180. Two greased bushings 180 reduces the likelihood of failure of the blind and creates a quiet design.

Idle end assembly 100 does not include spring 16 or metal strap 22 and therefore does not dissipate static electricity.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. An idle end assembly for a roller blind, comprising:

a splined bush;

a support, the support defining a shaft entirely located within the splined bush;

two sealed ball bearings;

a rotor, the rotor located within the splined bush, opposite the support, and engaged by the shaft, one of the two sealed ball bearings coupled to the support and the other one of the two sealed ball bearings coupled to the rotor;

a metal strap, the metal strap located opposite the rotor and the shaft, and pointing outwardly from the splined bush;

an end pin, the metal strap coupled to the rotor via the end pin; and one spring, the spring entirely located within the shaft and coupled to the metal strap via the end pin, wherein the idle end assembly, via the spring, the end pin, and the metal strap, dissipates static electricity, and wherein the idle end assembly utilizes the two sealed ball bearings for reducing friction and wear between the support and the splined bush and between the rotor and the splined bush.

2. The assembly of claim 1, wherein the splined bush comprises a plurality of splines or fins, and wherein the splined bush comprises an inner cylindrical surface.

3. The assembly of claim 2, wherein the inner cylindrical surface defines a void.

4. The assembly of claim 1, wherein the support is configured to engage an inner surface of one of the two sealed ball bearings.

5. The assembly of claim 1, wherein the shaft of the support includes a polygon cross sectional insert configured to engage the rotor.

6. The assembly of claim 5, wherein the insert and the metal strap each define an aperture.

7. The assembly of claim 6, wherein the end pin passes through the metal strap aperture, within the rotor, through the insert aperture and engages with the spring, wherein the spring is configured to be connected to ground to dissipate static electricity.

8. The assembly of claim 1, wherein the rotor is configured to engage an inner surface of one of the two sealed ball bearings.

9. An idle end assembly for a roller blind, comprising:

a splined bush, a support, one spring, two sealed ball bearings, a rotor, a metal strap, and an end pin;

the support defining a shaft entirely located within the splined bush; the shaft having an insert; the rotor located within the splined bush, opposite the support, and engaged by the insert; one of the two sealed ball bearings coupled to the support and another one of the two sealed ball bearings coupled to the rotor; the metal strap located opposite the rotor and the shaft, pointing outwardly from the splined bush, and coupled to the rotor via the end pin; the spring entirely located within the shaft;

the insert and the metal strap each having an aperture, the end pin passing through the metal strap aperture, within the rotor, through the insert aperture and engaging with the spring;

wherein the idle end assembly is configured to be inserted into a hollow end of a roller blind tube and to be positioned coaxially with the roller tube, and wherein the idle end assembly, via the spring, the end pin, and the metal strap dissipates static electricity.

* * * * *